US005259098A

United States Patent [19]

Gupta

[11] Patent Number: 5,259,098

[45] Date of Patent: Nov. 9, 1993

[54] STEAM-DRAWING PROCESS FOR YARNS

[75] Inventor: Mohinder K. Gupta, Bel Air, Md.

[73] Assignee: E. I. du Pont de Nemours and Company, Wilmington, Del.

[21] Appl. No.: 848,191

[22] Filed: Mar. 12, 1992

[51] Int. Cl.[5] ..... D02J 1/22

[52] U.S. Cl. ..... 28/246; 28/247; 28/240

[58] Field of Search ..... 28/246, 247, 240, 245, 28/219

[56] References Cited

U.S. PATENT DOCUMENTS

| | | | |
|---|---|---|---|
| Re. 31,783 | 1/1985 | Borenstein et al. . | |
| 3,048,467 | 8/1962 | Roberts et al. . | |
| 3,303,169 | 2/1967 | Pitzl . | |
| 3,413,397 | 11/1968 | Bierbaum et al. . | |
| 3,452,130 | 6/1969 | Pitzl . | |
| 3,452,131 | 6/1969 | Geerdes et al. . | |
| 3,452,132 | 6/1969 | Pitzl . | |
| 3,525,134 | 8/1970 | Coon . | |
| 4,012,816 | 3/1977 | Hatcher . | |
| 4,186,781 | 2/1980 | Kim et al. | 28/220 X |
| 4,301,102 | 11/1981 | Fernstrom et al. | 28/220 X |
| 4,505,013 | 3/1985 | Nelson . | |
| 4,691,947 | 9/1987 | Burkhardt et al. . | |
| 4,835,956 | 6/1989 | Sasaki et al. . | |

*Primary Examiner*—Clifford D. Crowder
*Assistant Examiner*—Bibhu Mohanty

[57] ABSTRACT

A process for drawing thermoplastic multifilament yarns, wherein the yarns have different natural draw ratios, at least one of which is greater than the machine draw ratio used in the process. The yarns are first impinged with a hot fluid to heat them to an elevated temperature and then stretched over a set of draw rolls at a single machine draw ratio. In a preferred aspect of the invention, the yarns are crimped after stretching. Preferably, the thermoplastic yarns are either polypropylene or polyamide yarns.

11 Claims, 6 Drawing Sheets

STEAM-DRAWING PROCESS FOR YARNS

BACKGROUND OF THE INVENTION

1. Field of the Invention

This invention relates generally to the production of multifilament yarns from synthetic polymers and more particularly to a unique process for drawing and orienting the yarns.

2. Description of the Related Art

Most fiber-forming polymers are relatively weak after they are extruded from a spinneret and cooled to form filaments. Thus, the filaments must usually be extended, or drawn, to develop optimum physical properties. This hot or cold stretching of the filaments helps to align and arrange the crystalline structure of the molecules and improves the yarn's tensile properties. A draw ratio for the multifilament yarns can be obtained by measuring the yarn's final length to original length per unit weight of yarn. During the drawing process, it is known to impinge hot air or steam on thermoplastic multifilament yarns in order to localize the draw point, reduce drawing tension, and reduce the coefficient of denier variation in the drawn products.

For example, Pitzl, U.S. Pat. No. 3,303,169 and U.S. Pat. No. 3,452,130, discloses nylon polyamide yarns and a hot fluid process for drawing them, and Pitzl, U.S. Pat. No. 3,452,132, discloses a similar process applied to polyester. Roberts et al., U.S. Pat. No. 3,048,467, concerns steam-drawing of polyolefins, particularly polyethylene and polypropylene. Bierbaum et al., U.S. Pat. No. 3,413,397, discloses steam-drawing and heat-setting of polypropylene which may be pigmented. The aforementioned references disclose other benefits of hot jet drawing, such as higher fiber tenacity, higher draw ratios, fewer broken filaments, and reduction of fiber shrinkage in boiling water. However, the benefits of hot fluid-drawing are considered economically insufficient to justify the cost on most polyamide and polyolefin production lines; as a result, hot fluid-drawing is normally used only on polyester.

A property of drawable polymeric filaments which is critically important in determining the optimum drawing conditions is the Natural Draw Ratio (NDR), described in greater detail below.

Generally, if the yarn is machine drawn at a draw ratio below the NDR of the yarn, there will be denier variation along the length of each filament, with corresponding segments of thick and thin diameter. The incompletely drawn sections of larger diameter will tend to dye darker than the more completely drawn material. The incompletely drawn sections will also appear darker if the yarns are pigmented.

Generally, if the yarn is machine drawn at a draw ratio above the NDR of the yarn, there will be less denier variation. The diameter along the length of a filament in such a yarn tends to be more uniform and there is increased fiber tenacity. Thus, it has been found that the optimum Machine Draw Ratio (MDR) for a yarn usually lies about 5-20% above its NDR. However, in some cases, it is very difficult to machine draw the yarns at such a draw ratio, because the yarns have very high NDRs. For example, the natural draw ratio for certain solution dyed nylon 66 yarns may be about 3.35:1 and possibly even greater, but the machine draw ratio for such yarns is typically set at about 2.8:1. If an attempt is made to draw such a yarn at a draw ratio 5-20% above its NDR, the process becomes inoperable with frequent filament breaks, resulting in an unacceptable product.

The present invention provides a process for drawing yarns having a natural draw ratio greater than the machine draw ratio used in the process.

Another difficult problem arises when two or more spun, but undrawn yarns, having different NDRs must be drawn on a single set of feed and draw rolls at a single machine draw ratio which is unlikely to be optimum for all of the yarns. For example, one of the yarns may have a NDR greater than the machine draw ratio and the other yarn may have a NDR less than the machine draw ratio. In other instances, both of the yarns may have different NDRs, but each is greater than the machine draw ratio.

In particular, the natural draw ratio for a yarn usually varies directly with the viscosity of the polymer and inversely with the degree of any copolymerization. Both of these factors are well known and controlled in the processing of conventional polymeric yarns. The addition of titanium dioxide as a delustrant raises the NDR, but the small amount usually employed (0.05-0.30 weight percent) has only a slight effect. Therefore, variation of the NDR has not been a serious problem in the past. More recently, larger amounts, such as 1 to 4 weight percent (wt. %), of color concentrates which include pigments and various other additives, such as UV stabilizers, antioxidants, delustrants, etc. have been incorporated into fiber-forming polymers. These color concentrates have been initially added to polyolefin polymers, since these polymers do not normally accept conventional dyes.

For example, a manufacturer of polypropylene carpet yarns has to supply its customers with a wide range of colors, some of which must be specially prepared on short notice. Pigmented polypropylene typically has a NDR of about 2.7:1 to 3.9:1. However, as shown in greater detail below, the different colorants and polymeric components of color concentrates can drastically change the NDR of the spun filaments in unpredictable directions. Thus, the optimum spinning and drawing conditions for each new color must be determined by a time-consuming and tedious process.

The drawing of solution dyed nylon carpet yarns also presents difficulties. For example, there are problems with drawing dark plum nylon yarns and light wheat nylon yarns over the same set of feed and draw rolls at a single draw ratio, because of the different natural draw ratios for the yarns. Furthermore, the dark plum nylon yarns have a higher NDR than the machine draw ratio typically used in the process.

Two references which disclose processes for drawing two or more yarns on the same set of rolls are Borenstein et al., U.S. Pat. No. 31,783, and Hatcher, U.S. Pat. No. 4,012,816, although there is no indication that the feed yarns used in these processes differ in any way.

The present invention provides a process, where two or more undrawn yarns having different natural draw ratios, at least one of which is greater than the machine draw ratio, are drawn on a single set of feed and draw rolls at a single machine draw ratio.

SUMMARY OF THE INVENTION

The present invention provides a process for drawing a multifilament thermoplastic yarn having a natural draw ratio (NDR) greater than the machine draw ratio used in the process. The invention also includes a process for drawing a plurality of thermoplastic multifilament yarns having different natural draw ratios, at least one of which has a natural draw ratio greater than the machine draw ratio.

This process involves impinging high velocity hot fluid on the undrawn filaments to separate them and to heat them rapidly as the yarns progress from a lower-speed feed roll to a higher-speed draw roll. The fluid may be air or, more preferably, steam. The steam is either saturated or superheated.

In one embodiment, at least two of the yarns are of a different color. Preferably, either polyamide or polypropylene yarns are used. The yarns may contain about 1 to 4 weight percent of a color concentrate. The color concentrate may be composed of pigments and various other additives such as, UV stabilizers, antioxidants, delustrants, etc. The undrawn polypropylene and polyamide yarns generally have a natural draw ratio of about 2.7:1 to 3.9:1 and are spun at about 500–700 yards per minute (ypm). The machine draw ratio is generally in the range of about 2.6:1 to 3.3:1.

The invention further includes a process comprising feeding the multifilament feed yarns substantially in parallel over the same feed roll(s) and through a device where high velocity hot fluid is impinged on them to separate the filaments and to heat them rapidly, passing the yarns substantially in parallel over the same draw roll(s), and winding them up either together on a single package or on separate packages.

The feed roll and/or draw rolls may be heated. Furthermore, the process may additionally include the steps of passing the yarns from heated draw rolls through a hot fluid jet bulking device where the filaments are crimped individually to produce random three-dimensional curvilinear crimp, cooling the crimped filaments at low tension, and then entangling the filaments of the component yarns under higher controlled tension before winding them together on a single package.

The invention also encompasses yarns made by the process of this invention.

DETAILED DESCRIPTION OF THE INVENTION

Figure 1:
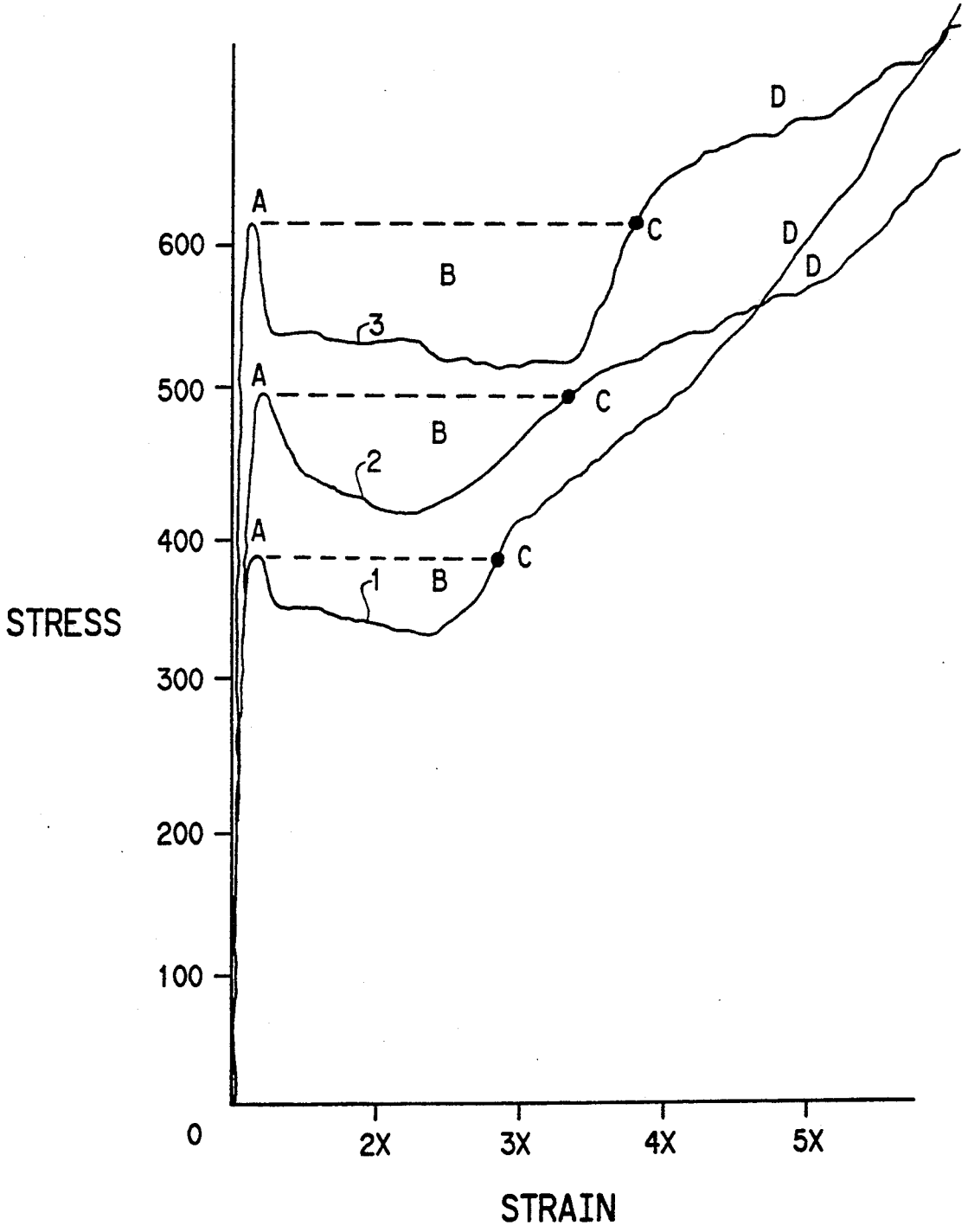
FIG. 1 shows stress-strain diagrams of three pigmented polypropylene filament species, pointing out Natural Draw Ratios and other characteristics.

The present invention relates to a process for drawing a multifilament yarn having a natural draw ratio (NDR) greater than the machine draw ratio (MDR) used in the process. The invention also includes a process for drawing a plurality of yarns having different natural draw ratios, at least one of which has a natural draw ratio greater than the machine draw ratio.

By the term, "natural draw ratio (NDR)", as used herein, it is meant the ratio of a yarn's final length to original length per unit weight of yarn, as determined by the "Testing Methods", described below. The polypropylene and polyamide yarns in the present invention generally have a natural draw ratio of about 2.7:1 to 3.9:1.

By the term, "machine draw ratio (MDR)", as used herein, it is meant the ratio of a yarn's final length to original length per unit weight of yarn as predetermined by the feed roll speed, draw roll speed, and other known conditions in the drawing process. Those skilled in the art are familiar with setting the machine draw ratio. In the present invention, the machine draw ratio is generally in the range of about 2.6:1 to 3.3:1.

Figure 2:
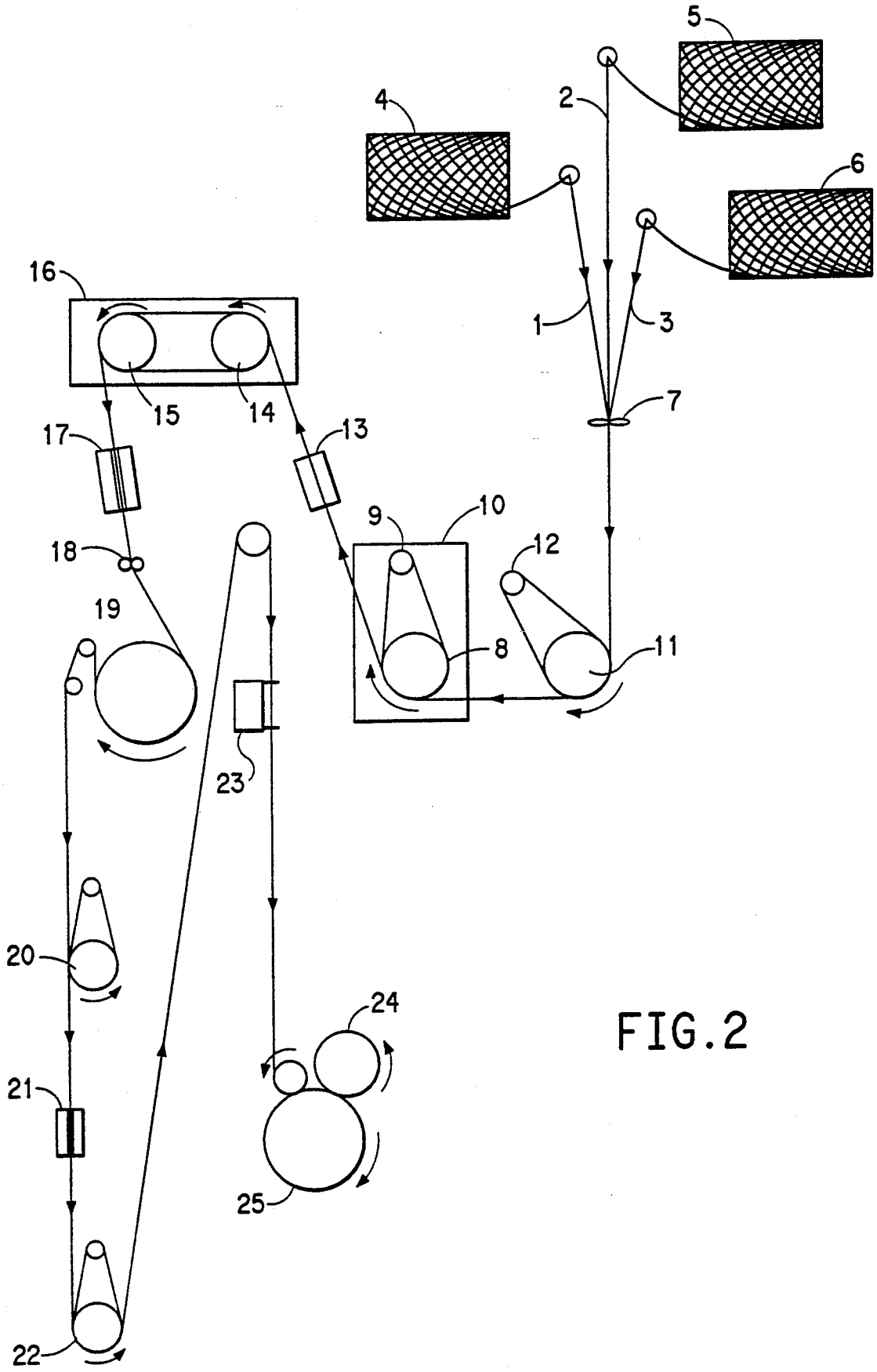
FIG. 2 is a schematic drawing of the process of this invention.

The process of this invention is illustrated in FIG. 2, where two or more undrawn or partially drawn yarns (1), (2) and (3), at least one of which differs from the others in NDR and at least one of which has a NDR greater than the machine draw ratio, are taken from their respective supply packages (4), (5) and (6), brought together at guide (7), and progress in parallel to and around feed roll (8) and its associated separator roll (9). If feed roll (8) is heated, it is preferably surrounded by an enclosure (10). Since the yarns are under a high degree of tension in the subsequent drawing zone, they may occasionally slip off rolls (8) and (9). Thus, an additional set of predraw rolls (11) and (12), running at a lower speed than rolls (8) and (9), is provided to prevent slippage of the yarns. The arrangement of these predraw rolls (11) and (12) assists in obtaining a high level of uniformity in the drawing operation.

The yarns then enter draw jet (13) supplied with hot fluid, preferably steam, from a source (not shown). The highly pressurized hot fluid is forced through a narrow passage of the draw jet and is impinged at a high velocity onto the filaments to separate them. The hot fluid rapidly heats the filaments and initiates drawing of them within the jet device. The yarns then contact draw rolls (14) and (15) running several times faster than feed roll (8). These rolls (14) and (15) are preferably heated to reduce the shrinkage of the drawn yarns and/or to preheat them for subsequent bulking. Enclosure (16) is optionally provided. A bulking device (17) supplied with hot fluid from a source (not shown) may be of the type which forms an accumulation of hot crimped filaments, such as the device described in Burkhardt et al., U.S. Pat. No. 4,691,947. Subsequently, the hot or partially cooled yarns are removed by metering roll (18) and deposited at low tension on drum (19), where ambient air is drawn through the yarns by suction within the drum to complete the cooling. Alternatively, the bulking device (17) may be of the type described in Coon, U.S. Pat. No. 3,525,134, in which case, the hot crimped yarns are deposited directly on drum (19).

When the component yarns are to be entangled together to form a larger coherent bundle, they pass through entangling jet (21) which may be of a type shown in Nelson, U.S. Pat. No. 4,505,013. In such a jet (21), high velocity fluid intermingles the filaments to provide cohesion and color blending if the component yarns are of different color or dyeability. The tension of yarns undergoing the entangling process is carefully controlled by the speeds of rolls (20) and (22). The combined yarns then pass through optional finish applicator (23) and to wind-up (24), where it is wound on package (25).

In the process of the present invention, it is preferable to employ draw jet devices of the type shown in the above-mentioned Pitzl patents which heat the filaments rapidly and localize the draw point in contrast to the long steam chambers described in the Roberts et al. and Bierbaum et al. patents.

Figure 3A:
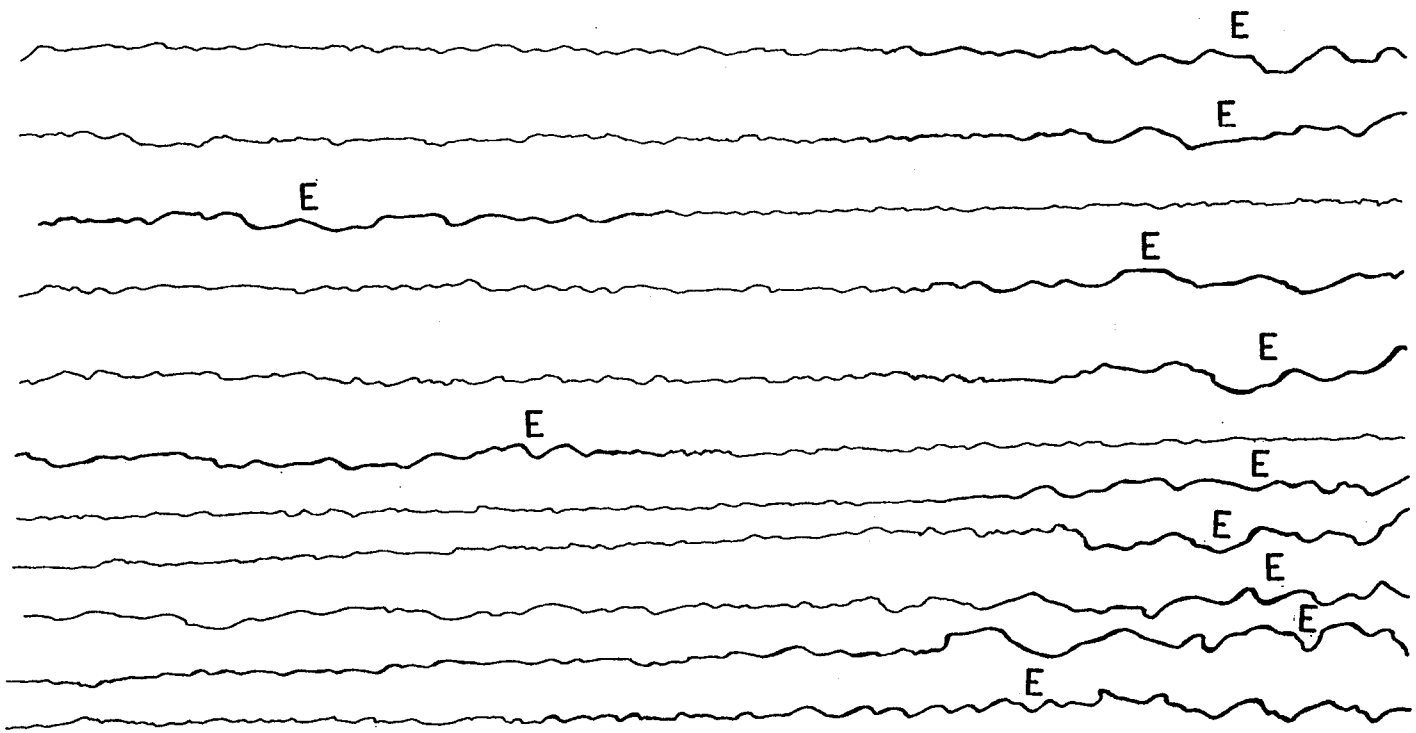
FIG. 3A is a schematic drawing of individual polypropylene filaments of Comparative Example 2 mounted on a card. The yarns composed of these filaments were drawn without steam.
Figure 3B:
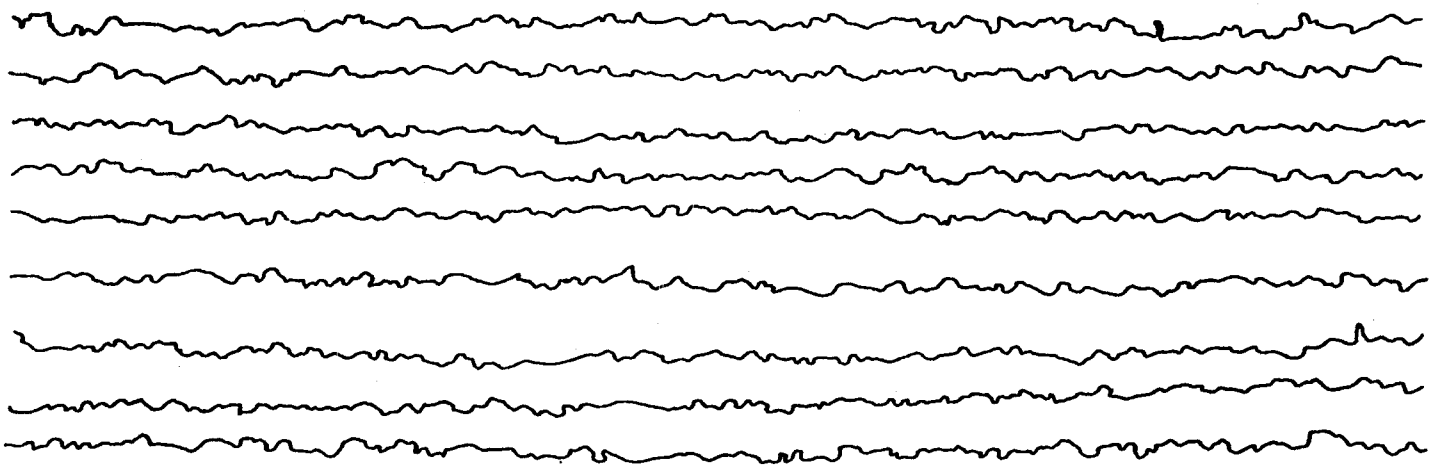
FIG. 3B is a schematic drawing of individual polypropylene filaments of Example 3 mounted on a card. The yarns composed of these filaments were drawn with steam.

The difference in uniformity of crimp between yarns treated by the process of this invention versus yarns treated by a conventional process can be seen in FIGS. 3A and 3B.

FIG. 3A shows polypropylene filaments having a NDR greater than the machine draw ratio and which have been crimped by the process illustrated in FIG. 2, except these filaments did not enter the hot fluid draw jet (13) and were not subjected to hot fluid during the drawing phase. The filaments have been extracted carefully from the entangled yarns and have been attached to a transparent surface under just enough tension to straighten their centerlines without significantly diminishing their crimp. Since the filaments contain a deep blue pigment, regions of larger transverse dimension due to incomplete drawing are easily seen. These regions, indicated by (E) also have fewer crimps due to the difficulty of crimping the larger diameter portions of the filament.

FIG. 3B shows polypropylene filaments having a NDR greater than the machine draw ratio and which have been crimped by the process illustrated in FIG. 2. The yarns were drawn with a hot fluid draw jet using saturated steam at about 139° C. in accordance with the present invention. It can be seen that the filament transverse dimensions are substantially uniform and all regions contain approximately the same degree of crimp.

The yarns used in the process of this invention may be composed of thermoplastic fiber-forming polymers, such as polyamides, e.g., nylon 6 and nylon 66, polyesters, polyolefins, e.g., polypropylene, and polyacrylonitriles. The resulting yarns exhibit a substantially uniform degree of crimp and may be tufted into carpets by techniques known in the art.

TESTING METHODS

Natural Draw Ratio (NDR)

The natural draw ratios for the filaments may be calculated by the method described below. Referring to FIG. 1 showing stress-strain diagrams of three undrawn pigmented polypropylene filaments, as they are extended, stress is shown on the vertical axis in grams and strain is shown on the horizontal axis as draw ratios. Diagram 1 represents a fiber containing Coral color concentrate (3.1 wt. %, Color Index No. 26293-F2); Diagram 2 represents a fiber containing Flint color concentrate (1.92 wt. %, Color Index No. 26063-F2); and Diagram 3 represents a fiber containing Forest color concentrate (1.7 wt. %, Color Index No. 26067-F2).

A one-inch (2.54 cm) sample of undrawn and unheated filament is placed in an Instron tensile tester and extended at the rate of 5 in/min. (0.127 m/min) to at least a draw ratio of 6:1. Stress rises rapidly until yield point (A) is reached, at which time a region of smaller diameter or "neck" forms and the stress drops. In region (B), the filament continues to draw at the neck until the entire sample is of the smaller diameter, at which time the stress equals that of yield point (A). The draw ratio at this point, shown as point (C) on the diagrams, is termed the natural draw ratio for the particular polymer.

The natural draw ratio is also found to be equal to the ratio of the filament's larger diameter before the draw neck to the filament's smaller diameter after the neck in region (B). As drawing continues beyond this point in region (D), the tenacity of the fiber increases as its diameter is further reduced until it breaks. The natural draw ratio, as reported in the following Examples, is the average of the natural draw ratio calculations for 10 filament samples. It can be seen that the three different colored filaments represented by diagrams 1, 2 and 3 have yield points (A) which differ greatly from each other.

The following examples further describe the invention but should not be construed as limiting the scope of the invention.

EXAMPLES

In the following examples, the color concentrates were obtained from Americhem, Inc. ® (2038 Main Street, Cuyahoga Falls, Ohio 44221). The color index numbers refer to Americhem identification numbers. The color concentrates used for producing nylon yarns generally contain pigments, nylon 6 polymer, and nylon 6/66/610 terpolymer, and various other additives such as delustrants and antioxidants. The color concentrates used for producing polypropylene yarns generally contain polypropylene polymer and various other additives such as delustrants and antioxidants.

EXAMPLE 1

In this example, the Natural Draw Ratios (NDRs) for various polypropylene yarn samples were determined. Polypropylene pellets having a Melt Flow Rate (MFR) of 15 and an intrinsic viscosity of 1.69 were melted in an extruder at 250° C. A different color concentrate for each yarn sample, as further described below in Samples A–C, was then added to the extruder and blended with the molten polymer to produce fiber-spinnable melts. Each polymer melt was then spun through a 45 hole spinneret into trilobal shaped pigmented filaments having a cross-section modification ratio of 2.9. After exiting from a quench chamber, a finish oil was applied to the undrawn yarns to keep them cohesive. The undrawn yarns were then fed to a wind-up roll where the yarns were wound-up at a rate of 666 yards per minute (ypm). The yarns had a total denier of about 2380 and about 53 denier per filament (dpf).

SAMPLE A

The fiber-spinnable melts for producing yarns of this sample contained about 3.1% by weight of color concentrate, Coral (Color Index No. 26293-F2), available from Americhem, Inc. The stress-strain relationship of these filaments is shown as Diagram 1 in FIG. 1. The Natural Draw Ratio (NDR) of the yarn was 2.76:1.

SAMPLE B

The fiber-spinnable melts for producing yarns of this sample contained about 1.92% by weight of color concentrate, Flint (Color Index No. 26063-F2), available from Americhem, Inc. The stress-strain relationship of these filaments is shown as Diagram 2 in FIG. 1. The NDR of the yarn was 3.29:1.

SAMPLE C

The fiber-spinnable melts for producing yarns of this sample contained about 1.7% by weight of color concentrate, Forest (Color Index No. 26067-F2), available from Americhem, Inc. The stress-strain relationship of these filaments is shown as Diagram 3 in FIG. 1. The NDR of the yarn was 3.68:1.

EXAMPLE 2 (COMPARATIVE)

In this comparative example, undrawn yarns were spun according to the process described in Example 1, but a different color concentrate was used. The fiber-spinnable melts for producing yarns in this sample contained about 1.95% by weight of color concentrate, Midnight Blue (Color Index No. 26358-F2), available from Americhem, Inc. The NDR of the yarn was 3.73:1.

The undrawn yarns were prepared at 600 yards per minute (ypm) spin speeds. The undrawn yarns had a total denier of about 2640 and about 59 denier per filament (dpf).

As shown in FIG. 2, the undrawn yarns were then fed across feed rolls heated at 100° C. and through a drawing zone at a nominal draw speed of 1500 yards per minute (ypm), but the yarns were not treated with a hot fluid while passing through the drawing zone. The Machine Draw Ratio was 3.28:1.

The yarns then passed across draw rolls heated at 140° C., and finally through a bulking jet which impinged the yarns with air heated to 155° C. The highly fluctuating degree of crimp in these filaments can be seen in FIG. 3A.

EXAMPLE 3

In this example, the fiber-spinnable melts for producing the undrawn yarns contained about 1.95% by weight of color concentrate, Midnight Blue (Color Index No. 26358-F2) available from Americhem, Inc., as described in Example 2. The NDR of the yarn was 3.73:1.

The undrawn yarns were prepared at 600 yards per minute (ypm) spin speeds, as described in Comparative Example 2. The undrawn yarns had a total denier of about 2640 and about 59 denier per filament (dpf).

As shown in FIG. 2, the undrawn yarns were then fed across feed rolls heated at 60° C. and through a drawing zone at a nominal draw speed of 1500 yards per minute (ypm), where the yarns entered a hot fluid draw jet. The filaments were impinged with saturated steam at a pressure of 60 psi within the draw jet. The Machine Draw Ratio was 3.28:1.

The yarns then passed across draw rolls heated at 140° C., and finally through a bulking jet which impinged the yarns with air heated to 155° C. The substantially uniform degree of crimp in these filaments can be seen in FIG. 3B.

EXAMPLE 4

In this example, fiber-spinnable melts were prepared according to the procedures described in Example 1, except different color concentrates were used, the polypropylene pellets had a melt flow rate (MFR) of 12, rather than 15, and the pellets were melted in the extruder at 235° C., instead of 250° C.

SAMPLE D

The fiber-spinnable melts for producing yarns of this sample contained about 1.85% by weight of color concentrate, Midnight Blue (Color Index No. 26358-F2), available from Americhem, Inc. The NDR of the yarn sample was 2.95:1.

SAMPLE E

The fiber-spinnable melts for producing yarns of this sample contained about 1.66% by weight of color concentrate, Moonbeam (Color Index No. 26062-F1), available from Americhem, Inc. The NDR of the yarn sample was 2.56:1.

SAMPLE F

The fiber-spinnable melts for producing yarns of this sample contained about 2.85% by weight of color concentrate, Wedgewood (Color Index No. 26060-F1), available from Americhem, Inc. The NDR of the yarn sample was 2.98:1.

Three yarn samples of the above different colors were spun, drawn and crimped by the process shown in FIG. 2 which included passing the yarns through a hot fluid draw jet, where the filaments were impinged with saturated steam. For comparative studies, the yarn samples were also fed through the steps shown in FIG. 2, except the yarns were not treated with a hot fluid while passing through the drawing zone. Referring to FIG. 2, in both of the above-described processes, the yarns were removed from drum (19) without passing through subsequent operations. It was found that the filaments were considerably easier to separate by this method, than if they were entangled by jet (21). The following process conditions were used during the drawing and bulking phases.

TABLE 1

| | Drawing With Steam | Drawing Without Steam |
|---|---|---|
| Feed Roll Temp. | 60° C. | 95° C. |
| Nominal Draw Speed | 1250 ypm | 1250 ypm |
| Machine Draw Ratio | 2.9:1 | 2.9:1 |
| Steam-Draw Jet (Saturated Steam Pressure) | 60 psi | None |
| Draw Roll Temp. | 130° C. | 130° C. |
| Bulking Jet Air Temp. | 175° C. | 175° C. |

The denier of 5 filaments from each yarn sample (D-F) was measured at 10 places along the length of each filament and the standard deviations (sigma) were calculated for the filaments of yarns drawn with steam and without steam. The results are presented in TABLE 2.

It can be seen that the denier uniformity of all the colored filaments is improved by the use of steam.

TABLE 2

| | Drawing With Steam (Std. Dev.) | Drawing Without Steam (Std. Dev.) |
|---|---|---|
| Sample D | | |
| Filament | | |
| (Fil.) #1 | 2.38 | 6.51 |
| Fil. #2 | 1.74 | 8.78 |
| Fil. #3 | 2.81 | 6.25 |
| Fil. #4 | 2.39 | 6.36 |
| Fil. #5 | 2.34 | 6.44 |
| Sample E | | |
| Fil. #1 | 1.75 | 2.15 |
| Fil. #2 | 1.37 | 2.08 |

TABLE 2-continued

| | Drawing With Steam (Std. Dev.) | Drawing Without Steam (Std. Dev.) |
|---|---|---|
| Fil. #3 | 1.55 | 2.97 |
| Fil. #4 | 1.43 | 3.56 |
| Fil. #5 | 2.17 | 2.00 |
| Sample F | | |
| Fil. #1 | 2.83 | 4.39 |
| Fil. #2 | 2.78 | 6.23 |
| Fil. #3 | 2.60 | 3.80 |
| Fil. #4 | 2.43 | 7.64 |
| Fil. #5 | 2.16 | 6.47 |

EXAMPLE 5

In this example, undrawn nylon 66 yarns were prepared according to the process conditions shown in TABLE 3.

TABLE 3

| | |
|---|---|
| Polymer Base | Nylon 66 |
| Color Conc. (Color Index No., available from Americhem, Inc.) | 27787-F2 |
| Color | Dark Plum |
| Wt. % Color Conc. | 1.96 |
| Throughput | 270 gm/min (2 ends) |
| Feed Roll Speed | 500 |
| Holes in 2 Ended Spinneret | 128 |
| Cross-Section of Filament | Square Hollow Filament |

NATURAL DRAW RATIO (NDR) OF UNDRAWN YARNS

The undrawn nylon yarns were extended on an Instron tensile tester, as described under "Testing Methods", and found to have a natural draw ratio (NDR) of 3.35:1.

The nylon yarn samples were drawn and crimped by the process shown in FIG. 2 which included passing the yarns through a hot fluid draw jet, where the filaments were impinged with saturated steam. For comparative studies, the nylon yarn samples were also fed through the process shown in FIG. 2, except the yarns were not treated with a hot fluid while passing through the drawing zone. The following process conditions were used during the drawing and bulking phases.

TABLE 4

| Drawing of Undrawn Yarns | |
|---|---|
| Feed Roll Speed | 700 ypm |
| Draw Roll Speed | 1960 ypm |
| Machine Draw Ratio | 2.8:1 |
| Draw Roll Temperature | 180° C. |
| Bulking Jet (psi) | 115 |
| Bulking Jet Air Temperature | 220° C. |
| Saturated Steam Pressure With Steam-Draw | 60 psi |

Figure 4A:
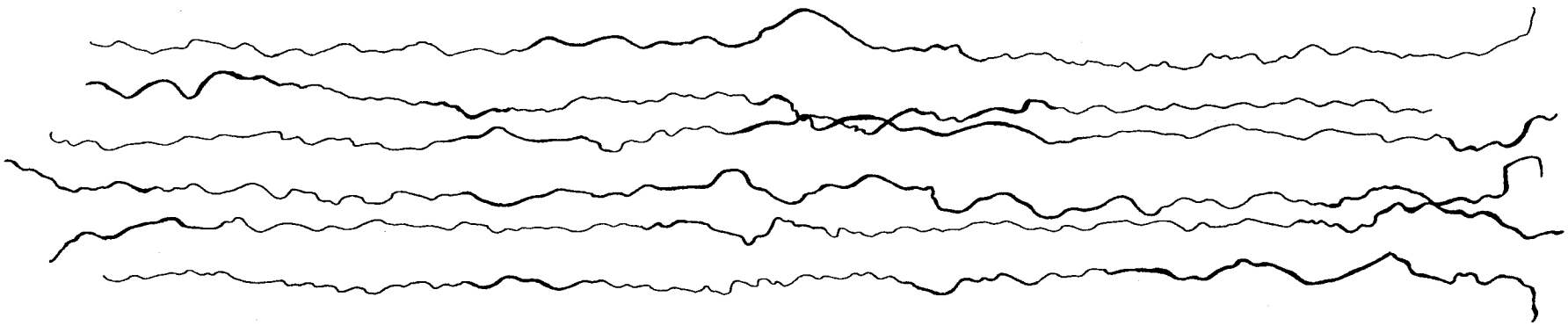
FIG. 4A is a schematic drawing of individual nylon filaments of Example 5 mounted on a card. The yarns composed of these filaments were drawn without steam.
Figure 4B:
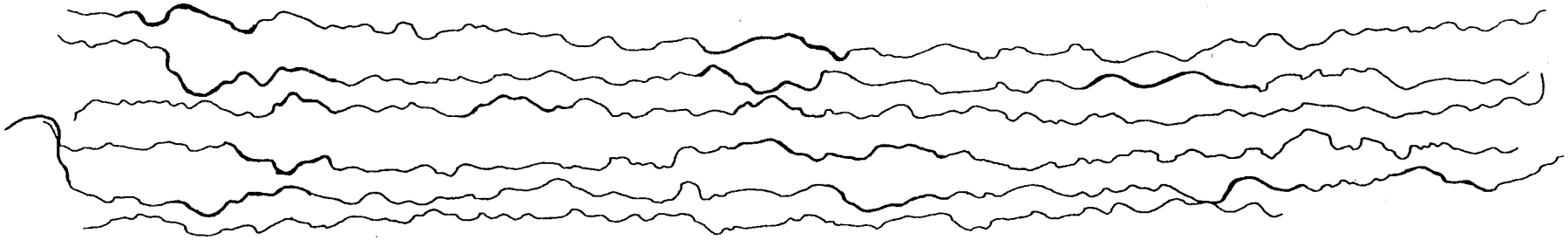
FIG. 4B is a schematic drawing of individual nylon filaments of Example 5 mounted on a card. The yarns composed of these filaments were drawn with steam.

The appearance of the filaments was visually examined on cards and it was found that filaments drawn without steam exhibited a nonuniform thickness with marked thick and thin sections as shown in FIG. 4A, while the filaments drawn with steam generally exhibited a more uniform thickness, as shown in FIG. 4B. The denier of 5 filaments from each nylon yarn sample (1–5)was measured at 10 places along the length of each filament and the standard deviations (sigma) were calculated for the filaments of yarns drawn with steam and without steam. The results are presented in TABLE 5.

It can be seen that the denier uniformity of the filaments is improved by the use of steam.

TABLE 5

| | Drawing Without Steam | | Drawing With Steam | |
|---|---|---|---|---|
| Filament | Avg. Denier | Std. Dev. | Avg. Denier | Std.Dev. |
| #1 | 21.2 | 5.64 | 20.8 | 4.85 |
| #2 | 24.9 | 8.22 | 21.9 | 7.87 |
| #3 | 22.2 | 4.37 | 19.9 | 3.74 |
| #4 | 21.8 | 5.34 | 18.3 | 3.77 |
| #5 | 25.5 | 8.63 | 19.1 | 2.63 |
| Overall Avg. | 23.1 | 6.44 | 20.0 | 4.57 |

The natural draw ratio (NDR) of the undrawn nylon yarns was determined to be 3.35:1. Thus, to be fully drawn, the machine set draw ratio should be in excess of 3.35:1. However, at such draw ratios, the drawing process becomes inoperable with many breaks, so a draw ratio of 2.8:1 was used which is typical in the art. It is unusual to find that steam-drawing would yield uniformity of draw even at machine draw ratios lower than NDR. This same phenomenon was observed with polypropylene.

I claim:

1. A process for drawing yarns, comprising the steps of:

a) passing a plurality of thermoplastic multifilament feed yarns across a feed roll at least two of the yarns having different natural draw ratios;

b) impinging the yarns with a high velocity hot fluid; and c) passing the yarns over a draw roll and stretching the yarns at a single machine draw ratio less than the natural draw ratio of at least one of the yarns.

2. The process of claim 1, wherein at least two of the feed yarns are of a different color.

3. The process of claim 1, wherein the hot fluid is saturated steam.

4. The process of claim 3, wherein the feed yarns are polypropylene yarns containing about 1 to 4 weight percent of a color concentrate and having a natural draw ratio of about 2.7:1 to 3.9:1.

5. The process of claim 3, wherein the feed yarns are polyamide yarns containing about 1 to 4 weight percent of a color concentrate and having a natural draw ratio of about 2.7:1 to 3.9:1.

6. The process of claim 1, wherein the draw rolls are heated and further comprising the step of:

d) crimping the yarns.

7. A process for drawing a yarn, comprising the steps of:

a) passing a thermoplastic multifilament feed yarn having a natural draw ratio across a feed roll;

b) impinging the yarn with a high velocity hot fluid; and c) passing the yarn over a draw roll, and stretching the feed yarn at a single machine draw ratio less than the natural draw ratio of the yarn.

8. The process of claim 7, wherein the hot fluid is saturated steam.

9. The process of claim 8, wherein the yarn is a polypropylene yarn containing about 1 to 4 weight percent of a color concentrate and having a natural draw ratio of about 2.7:1 to 3.9:1.

10. The process of claim 9, wherein the yarn is a polyamide yarn containing about 1 to 4 weight percent of a color concentrate and having a natural draw ratio of about 2.7:1 to 3.9:1.

11. The process of claim 8, wherein the draw roll is heated and further comprising the step of:

d) crimping the yarn.

* * * * *